US007225817B2

(12) United States Patent
Eichhorn et al.

(10) Patent No.: US 7,225,817 B2
(45) Date of Patent: Jun. 5, 2007

(54) CLEANING DEVICE FOR THE SHAVING HEAD OF A DRY SHAVING APPARATUS

(75) Inventors: Reinhold Eichhorn, Idstein (DE); Detlef Gleich, Friedrichsdorf (DE); Sebastian Hottenrott, Idstein (DE); Peter Junk, Seelenberg (DE); Christof Kleemann, Eschborn (DE); Michael Odemer, Niddatal (DE); Thorsten Pohl, Mühlheim (DE); Tobias Schwarz, Schmitten (DE); Jürgen Wolf, Kriftel (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/932,505

(22) Filed: Sep. 2, 2004

(65) Prior Publication Data

US 2005/0126611 A1 Jun. 16, 2005

Related U.S. Application Data

(63) Continuation of application No. PCT/EP02/12928, filed on Nov. 19, 2002.

(30) Foreign Application Priority Data

Mar. 2, 2002 (DE) ..... 102 09 326

(51) Int. Cl.
*B08B 3/10* (2006.01)
*B26B 21/40* (2006.01)

(52) U.S. Cl. ..... 134/105; 134/111; 134/186; 30/538

(58) Field of Classification Search ..... 134/105, 134/107–108, 111, 186; 30/41, 41.5, 538
See application file for complete search history.

(56) References Cited

U.S. PATENT DOCUMENTS

| | | | | |
|---|---|---|---|---|
| 3,365,267 | A * | 1/1968 | Mekiney et al. | 422/116 |
| 5,614,030 | A * | 3/1997 | Braun | 134/22.1 |
| 5,649,556 | A | 7/1997 | Braun | |
| 5,711,328 | A * | 1/1998 | Braun | 134/111 |
| 6,263,890 | B1 * | 7/2001 | Hoser | 134/111 |
| 6,305,391 | B1 * | 10/2001 | Hoser | 134/111 |
| 6,568,409 | B1 * | 5/2003 | Fleck | 134/110 |
| 6,626,194 | B2 * | 9/2003 | Wong | 134/102.2 |
| 6,698,437 | B2 * | 3/2004 | Hoser et al. | 134/104.4 |

FOREIGN PATENT DOCUMENTS

| | | |
|---|---|---|
| DE | 44 02 237 | 3/1995 |
| DE | 199 18 287 | 2/2000 |

* cited by examiner

*Primary Examiner*—Joseph L. Perrin
(74) *Attorney, Agent, or Firm*—Fish & Richardson P.C.

(57) ABSTRACT

A cleaning device for the shaving head of a dry shaving apparatus includes a receptacle having a reservoir adapted to receive the a shaving head and a pump to transfer a cleaning fluid from the reservoir and into the receptacle. A controllable drain disposed between a lower region of the receptacle and the reservoir redirects cleaning fluid away from the reservoir until needed thereby prolonging the time for which the cleaning fluid is in contact with the shaving head to be cleaned.

48 Claims, 3 Drawing Sheets

CLEANING DEVICE FOR THE SHAVING HEAD OF A DRY SHAVING APPARATUS

CROSS-REFERENCE TO RELATED APPLICATIONS

This is a continuation of PCT application serial no. PCT/EP02/12928, filed Nov. 19, 2002, which claims priority to German Patent Application No. 102 09 326.1, filed on Mar. 2, 2002, which is incorporated herein by reference in its entirety.

TECHNICAL FIELD

This description relates to a cleaning device for the shaving head of a shaving apparatus, for example a dry electric shaver.

BACKGROUND

Devices have been developed for cleaning the shaving head of a dry shaving apparatus. For example, German Patent No. DE 44 02 237 C1, the entire contents of which are incorporated herein by reference, discloses a receptacle configured for receiving the shaving head of a dry shaving apparatus. The receptacle is trough-shaped to conform to the contour of the shaving head and fully accommodates said shaving head. The receptacle has an outlet opening and an overflow which lead into a collecting container. The collecting container is connected by a conduit to the reservoir for the cleaning fluid. At the beginning of the cleaning cycle the cleaning fluid is conveyed by the motor-driven impelling device out of the reservoir into the receptacle. The outlet opening and the impelling device are coordinated such that the cleaning fluid is discharged through the outlet opening as well as through the overflow into the collecting container. The overflow acts simultaneously as a safety device which prevents the cleaning fluid from exceeding a predetermined level in the receptacle. In this way cleaning fluid is flushed through the receptacle continuously during the cleaning cycle. Hair residues are permanently carried away as the result of the continuous flushing of the receptacle.

Due to the continuous flushing of the receptacle, the impelling device has to be maintained in operation for the full length of the cleaning cycle. Furthermore, the impelling device requires a relatively high delivery rate in order for the receptacle to always be full during the cleaning cycle and for the cleaning fluid to be discharged through the outlet opening as well as through the overflow. The high motor speed and the resultant relatively high level of noise can be disturbing for a user. Alternative approaches reduce the size of the outlet opening, thereby reducing the throughput of cleaning fluid. Accordingly, the motor and the motor-driven impelling device could be operated at a lower speed, which would result in a reduction of the noise. However, the outlet opening has to be of a size sufficient for the flushed out hair residues to be discharged and, it is impractical to readily reduce the size of the outlet opening. Furthermore, the cleaning effect of the cleaning device with the current throughput of cleaning fluid is already insufficient in some cases. In particular when the shaving head is not cleaned immediately after use of the dry shaving apparatus, residues on the shaving head, which include skin and hair particles in combination with serum, perspiration, water and/or skin cream, may dry out, thereby forming particularly stubborn deposits. In extreme cases neither the cleaning fluid stream in the receptacle nor the additional movement of the shaving head are sufficient to dislodge these stubbornly adhering deposits within a short time. It may not even be possible to reliably dissolve or at least incipiently dislodge these deposits in a brief soaking stage preceding the cleaning cycle. Consequently, the cleaning process takes a very long time to achieve a satisfactory cleaning result on the shaving head. However, the long running times of the motor-driven impelling device and the dry shaving apparatus lead to a considerable noise nuisance. Furthermore, various constituents of the cleaning fluid, e.g., alcohol, may attack the components of the dry shaving apparatus and the cleaning device during lengthy cleaning processes, thus limiting the choice of suitable materials and applied surface finishes.

SUMMARY

A cleaning device for a shaving head of a dry shaving apparatus is configured to remove even stubborn deposits on the shaving head. The cleaning device is of straightforward construction and produces low noise levels.

According to one aspect, the cleaning device includes a controllable drain through which the receptacle can be evacuated controllably. The controllable drain prevents the cleaning fluid from draining from the receptacle prematurely. Consequently, the motor which drives the impelling device can be switched off once the cleaning fluid has reached a level in the receptacle that is sufficient for the cleaning. Hence it is not necessary for the motor and the impelling device to run permanently during the cleaning cycle, thus leading to a considerable reduction of noise emission by the cleaning device. The pump speed needed to fill the receptacle for the cleaning cycle is now conditional only on the desired filling time and no longer on the technical features of the cleaning device, e.g., the quantity passing through the outlet opening. Consequently, the pump speed and hence the noise emission can be reduced further. The new cleaning device also enables a soaking stage prior to the actual cleaning cycle, without the user being disturbed acoustically in the process. This soaking stage can thus be considerably prolonged, leaving the cleaning fluid with more time to dissolve the firmly adhering deposits. Another advantage is the significantly reduced quantity of circulated cleaning fluid. Unlike with permanent circulation, the cleaning fluid dwells longer in the cleaning fluid reservoir, as the result of which the dirt particles carried away from the shaving head have far more time to settle in the cleaning fluid reservoir. When cleaning fluid is next conveyed from the reservoir, the aspirated cleaning fluid is less loaded with dirt particles. In consequence, the filter connected upstream of the pump is less loaded with dirt particles, thus extending its useful life.

In an advantageous aspect the controllable drain is a channel whose construction is based on the principle of the pipette. The channel connects the receptacle in the lower region to the cleaning fluid reservoir, the reservoir being arranged underneath the receptacle. The channel has a section which is arranged above the maximum fluid level for the cleaning in the receptacle. As the receptacle is being filled, the part of the channel lying ahead of said section is filled simultaneously. The drain is controlled by means of the pump. Once the cleaning cycle is terminated, the pump is switched on briefly so that cleaning fluid continues to be fed into the receptacle. At the same time the fluid level in the channel rises into the section which is arranged above the maximum fluid level required for the cleaning. The cleaning fluid is thus able to flow back into the cleaning fluid reservoir. In accordance with the principle of the pipette, the cleaning fluid continues to flow, in spite of the pump being off, through the channel into the cleaning fluid reservoir, even when the fluid is below the maximum level in the receptacle required for the cleaning. In this way the receptacle is evacuated almost completely within a short time. The time required for evacuation depends in this case on the flow cross sections implemented and the height differential between the lower region of the receptacle and the cleaning fluid reservoir. All the dislodged particles are reliably removed from the receptacle by the suction occurring while draining. The advantage of this embodiment is that no additional components are needed for evacuating the receptacle thanks to using the physical effect. In particular no wearing seals are needed to make sure that the cleaning fluid remains in the receptacle during the cleaning process. Furthermore, the controllable drain has no throttling elements on which residues can collect.

As the result of the controllable drain it is possible for the receptacle to be emptied faster than residual fluid drips out of the shaving head. This residual amount of cleaning fluid collects in the lower region of the receptacle but no longer reaches the fluid level at which the cleaning fluid drains off through the channel in accordance with the pipette principle. The residual amount would now evaporate before being used again, normally on the next day. This would result in an unacceptably high level of cleaning fluid consumption. The evaporation of this residual amount can be prevented by a bypass arrangement. The bypass bypasses the channel section lying above the maximum fluid level required for the cleaning. Furthermore, the bypass has a particularly small effective flow cross section. As the result, the fluid level in the receptacle drops only insignificantly during the cleaning cycle, but the residual amount is nevertheless able to flow back into the cleaning fluid reservoir before evaporating. On the one hand the small effective flow cross section of the bypass can be obtained by material placed in the bypass to hinder the draining of the cleaning fluid. This material can be a fabric, for example, preferably a material of the mat- or wick-type. On the other hand a small effective flow cross section can be realized by a bypass with a very small diameter.

Through specially selected flow cross sections and a suitable height differential between the beginning and the end of the channel it is possible to achieve a relatively high flow velocity and hence a fast evacuation of the receptacle. The advantage of a high flow velocity is that the deposits and hair particles which are dislodged during the cleaning and settle in the lower region of the receptacle are entrained by the fluid stream during draining, thus effectively preventing clogging of the bypass opening.

In another aspect the controllable drain is a channel, which connects the lower region of the receptacle to the cleaning fluid reservoir, and a closing device, which is arranged in the channel and opens or closes the channel. The closing device has a particularly simple construction when it is constructed as a valve. The valve is opened or closed as required depending on the cleaning process. The valve can be an electromagnetic valve, for example. Furthermore, it is conceivable to arrange movable elements around the channel as a closing device, which squeeze a flexible channel wall in this area such that cleaning fluid is not allowed to drain into the reservoir. The essential advantage of these aspects lies in a relatively short length of channel between the receptacle and the cleaning fluid reservoir. As the result the space requirements of the cleaning device are low.

The arrangement of a sensor is advantageous for filling the receptacle with an adequate amount of cleaning fluid for the cleaning process. In the case of a cleaning device that uses a channel based on the pipette principle in order to perform as a controllable drain, the sensor is advantageously arranged in or on this channel. With this arrangement the sensor is protected from damage, e.g., when the dry shaving apparatus is inserted in the receptacle. A sensor of this type can be, for example, a float-actuated switch for switching off the pump. In this embodiment the float rises with the cleaning fluid entering the receptacle. Once the cleaning fluid reaches the necessary level in the receptacle, the switch is actuated by the float and the further inflow of cleaning fluid is stopped. It is also possible to use a capacitive sensor. The latter is then arranged at the height of the desired fluid level. Once the cleaning fluid reaches the sensor, the signal measured by the sensor changes, e.g., conductance, capacitance. The pump can be controlled by means of this change of signal.

In another embodiment sufficient filling of the receptacle with cleaning fluid can be regulated particularly easily by way of the pump ON time. As the pump's delivery rate is constant, the pump's ON time can be used as a yardstick for the fluid level. The essential advantage of this embodiment is that no additional sensor needs to be positioned proximate the receptacle.

If the inlet for the cleaning fluid into the receptacle is arranged in the lower region, it is an advantage to arrange a check valve in the inlet. The inlet is thus closed, making it impossible for any cleaning fluid to flow back through the inlet into the cleaning fluid reservoir when the pump is deactivated. In other embodiments it is possible to dispense with the arrangement of a check valve if the pump stage prevents the cleaning fluid from running back into the reservoir or if the inlet for the cleaning fluid into the receptacle is arranged above the fluid level required for the cleaning process.

It is an advantage to arrange an overflow in order to prevent the cleaning fluid from escaping out of the receptacle to the outside, e.g., due to obstruction of the controllable drain or non-deactivation of the pump. The overflow is arranged above the fluid level at which the cleaning fluid flows through the controllable drain back into the cleaning fluid reservoir. This ensures that the operation of the controllable drain, particularly when using a channel based on the pipette principle, is not disturbed by the overflow. If the overflow is connected to the cleaning fluid reservoir, the overflow can also act as an aerating and venting conduit for the reservoir, thus ensuring a substantially faster return of the cleaning fluid.

The cleaning effect of the cleaning device can be enhanced further when the receptacle or the cleaning fluid in the receptacle is heatable by a heating element. The adhering effect of the deposits on the shaving head is attributable mainly to serum and skin creams. A main constituent of skin creams is vaseline. The melting points of serum and vaseline lie at 37° C. and 39° C. When the deposits are heated to a temperature above 40° C. these two constituents soften, making it easier to dislodge them. Dislodging can be improved still further if the cleaning fluid is agitated as by the shaving head. This produces a suspension in which the deposits can be found finely dispersed in the cleaning fluid. While the cleaning fluid is being conveyed into the cleaning fluid reservoir, the temperature of the cleaning fluid drops, causing the dislodged deposits in the reservoir to settle when the temperature of the cleaning fluid drops below the melting points.

Heating the cleaning fluid has the following advantages. On the one hand the firmly adhering deposits are more effectively softened and incipiently dislodged as the result of the higher temperature of the cleaning fluid, making them easier to remove by the fluid stream. On the other hand the heating of the cleaning fluid also increases its chemical effectiveness, which again promotes the dislodging of the deposits. It is thus possible to remove deposits which were previously impossible to dislodge. At the same time the ON time of the dry shaving apparatus during the cleaning process can be significantly reduced, which also means that the noise nuisance for the user is reduced further. Considering that heating the cleaning fluid supports the chemical effectiveness of the fluid, it is possible to resort to less aggressive constituents while achieving the same cleaning effect, thereby reducing environmental pollution and the load acting on the cleaning device, e.g., paints and surface finishes. Furthermore, the heating can be used for the subsequent drying of the shaving head. A blower of the type used in conventional devices can be dispensed with. The construction of the cleaning device is thus simplified. This also means that the noise nuisance caused by the blower is also eliminated. In another embodiment the existing residual amount of cleaning fluid can be evaporated by the heater in the subsequent drying process. The shaving head is thus largely disinfected.

Heating can be performed by means of one or several electrical resistors in the form of a wire, a foil or a printed, chemically or physically deposited electrically conductive layer in the receptacle or in the direct vicinity of the receptacle. The heater can be arranged in the dry shaving apparatus as well as in the cleaning device, with the heating element standing in contact with the cleaning fluid either directly or indirectly through a thermal conductor or at least an electrically insulating intermediate layer. In another embodiment the receptacle is comprised of an electrically conductive plastic part and thus forms the heating element itself.

It is also conceivable to construct the heating element as an electric heating radiator which heats the cleaning fluid directly or by way of a thermal conductor. In the latter case in particular, the heating radiator is not tied to any one point of installation.

In another embodiment the heating element is comprised of metal parts in which eddy currents are produced with a high-frequency electric field, which lead in turn to the heating of the metal parts. The metal parts can heat the cleaning fluid directly as well as indirectly. Particularly advantageous in this embodiment is the use of the shaving head, particularly the metal cutting parts, as a heating element. If the heating in this embodiment is also used for the subsequent cleaning, a disinfecting effect can be achieved, without any evaporation of the cleaning fluid, by raising the temperature of the metal parts accordingly.

It is also conceivable to use as a heating element one or several chemical substances which enter into an exothermal reaction through contact with each other or with other substances, using the heat thus released for the heating. Depending on the system selected, the chemical reaction can be started once or several times. Starting several times is particularly easy to perform by adding the second reactant at staggered times. The cleaning fluid itself is advantageously a reactant or a constituent in which the reaction takes place. It is also possible for the reaction to take place separately from the cleaning fluid and to feed the heat subsequently to the cleaning fluid.

Suitable devices are provided, preferably a temperature sensor, in order to maintain a predetermined maximum temperature. Particularly suitable is the use of a temperature-responsive resistor as a heating element. In this instance the heating element performs the task of the sensor and automatically reduces the heating power when a predetermined temperature is exceeded. Furthermore it is an advantage to select the heating power low enough to reach a temperature that is just about sufficient in the stationary state.

For effective operation of the cleaning device the heating power can be higher at the beginning in order to achieve a fast heating up process. After a certain time or detection of a certain state the heating power is reduced to a sufficient, lower temperature. Advantageously, only one charge of the receptacle with cleaning fluid is heated up each time during the cleaning cycle. The remaining cleaning fluid remains at room temperature, thus enabling a possible subsequent flushing operation to be performed with colder cleaning fluid. The advantage of this is that a fraction of the fat components dislodged by the hot cleaning are evenly distributed again on the parts of the shaving head where they act as a lubricant.

To ensure that the dry shaving apparatus cannot be removed from the cleaning device while a cleaning cycle is in progress, it is advantageous to lock the dry shaving apparatus in the cleaning device. This prevents cleaning fluid from escaping unintentionally when the dry shaving apparatus is removed. In this arrangement, an automatic lock which locks the dry shaving apparatus at the beginning of the cleaning cycle and unlocks it automatically at the end is particularly advantageous. A lock of this type is very convenient as it is performed without any intervention on the user's part.

It is particularly easy for the locking to be implemented hydraulically by means of a reversible pump. When the pump is operated in conveying direction the dry shaving apparatus is locked by suitable locking elements, and when the direction of rotation of the pump is reversed it is unlocked. If a check valve is arranged in the inlet to the receptacle and if the pressure for actuating the locking elements is less than the pressure to open the check valve, then the circuit for the locking and unlocking can be fluidically connected to the cleaning circuit without this resulting in an impairment of the fluid conveyance for the cleaning. An embodiment of this type has the added advantage that the dry shaving apparatus is first locked before cleaning fluid is conveyed into the receptacle.

Further objects, features, advantages and application possibilities will become apparent from the description and drawings, and from the claims.

DETAILED DESCRIPTION

Figure 1:
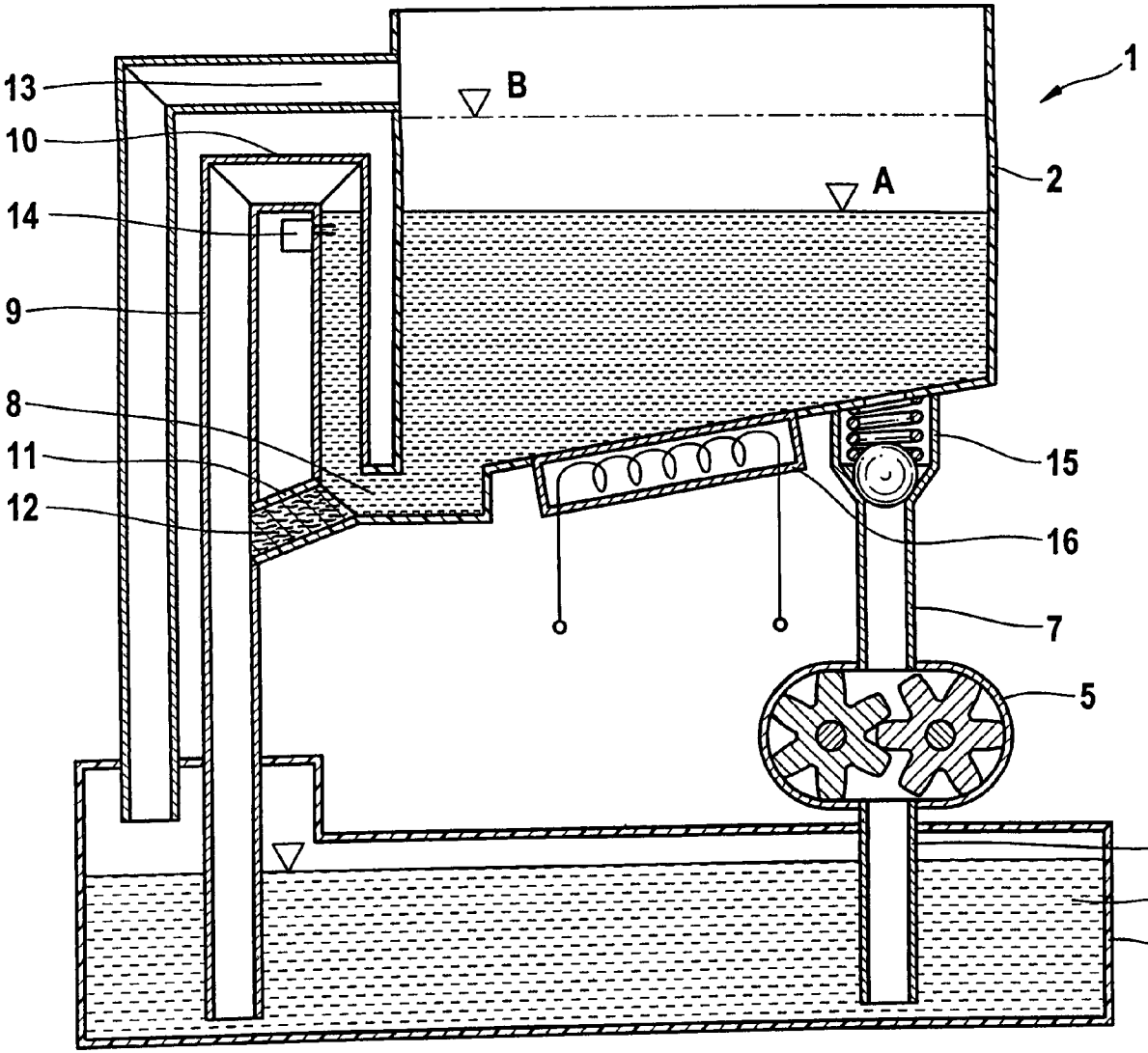
FIG. 1 is a schematic view of the cleaning device.

The cleaning device 1 shown in FIG. 1 includes a receptacle 2 and a reservoir 3 for containing cleaning fluid 4. A pump 5 is arranged as an impelling device adapted to be driven by a motor. The pump 5 is constructed as a gear pump. However, any other suitable displacement or flow pump could be substituted. The pump 5 draws up the cleaning fluid 4 from the reservoir 3 by way of an intake pipe 6 and conveys it through an inlet 7 into the receptacle 2. A check valve 15 is arranged in the inlet 7 in order to prevent the cleaning fluid 4 from draining through the inlet 7. The check valve 15 could be dispensed with if the pump 5 were designed such that it would prevent the cleaning fluid from running back to the reservoir 3. A dry shaving apparatus, not shown, is insertable with its shaving head down into the receptacle 2, such that the shaving head is accommodated by the receptacle 2. In one embodiment, the receptacle is configured to accommodate the entire shaving head. One end of a channel 9 is arranged in the lower region 8 of the receptacle 2. The channel 9 extends from the lower region 8 upward. In an upper region 10 the channel 9 is deflected downward and leads into the reservoir 3 for the cleaning fluid 4.

A bypass 11 connects the lower region 8 of the receptacle 2 to the channel 9 by bypassing the upper region 10. The bypass 11 can be filled with a mat-type material 12. In one embodiment, the mat-type material 12 has such a low level of permeability for the cleaning fluid 4 that the level of the cleaning fluid 4 in the receptacle 2 can drop during an entire cleaning process by an amount that does not impair the cleaning of the shaving head. An overflow 13, which leads likewise into the reservoir 3, is arranged in the upper part of the receptacle 2 above the region 10 of the channel 9. At the beginning of the cleaning cycle the pump 5 conveys cleaning fluid 4 into the receptacle 2, whereby the channel 9 is also filled in part (the right-hand section in the drawing). In one embodiment. Aa capacitive fluid level sensor 14 is arranged in the channel 9. When the cleaning fluid 4 reaches the fluid level sensor 14, a corresponding output signal stops the pump 5. At this moment the cleaning fluid 4 has reached a first level A. The level A is the maximum fluid level required for the cleaning, at which the shaving head of the dry shaving apparatus is sufficiently immersed in the cleaning fluid 4. The level A lies directly below the upper region 10 of the channel 9. To evacuate the receptacle 2, the pump 5 starts again, feeding additional cleaning fluid 4 into the receptacle 2 until the cleaning fluid 4 rises quickly to a second level B. The pump 5 is then stopped, and the cleaning fluid 4 is discharged through the upper region 10 of the channel 9 into the reservoir 3. Channel 9 is sized and configured to form a siphon, with the upper region 10 in conjunction with the receptacle 2 such that the channel section lying upstream from the upper region 10 forms a pipette. Consequently, even after the pump 5 is switched off and the fluid level drops below the levels B and A, the cleaning fluid continues to flow through the channel 9 and into the reservoir 3 until the receptacle 2 has been emptied. This process takes a few seconds when the flow cross sections are suitably designed. Any remaining cleaning fluid 4 dripping from the shaving head collects in the lower region 8, yet without reaching the level B, at which point evacuation of the receptacle 2 would begin automatically. The remaining residual amount can returns to the reservoir 3 through the bypass 11. Should the cleaning fluid 4 rise above the level B, the overflow 13 returns the surplus cleaning fluid reliably to the reservoir 3. In one embodiment, an electrical resistance heating element 16 arranged underneath the receptacle 2 allows the cleaning fluid 4 to be heated prior to and/or during the cleaning cycle.

Figure 2:
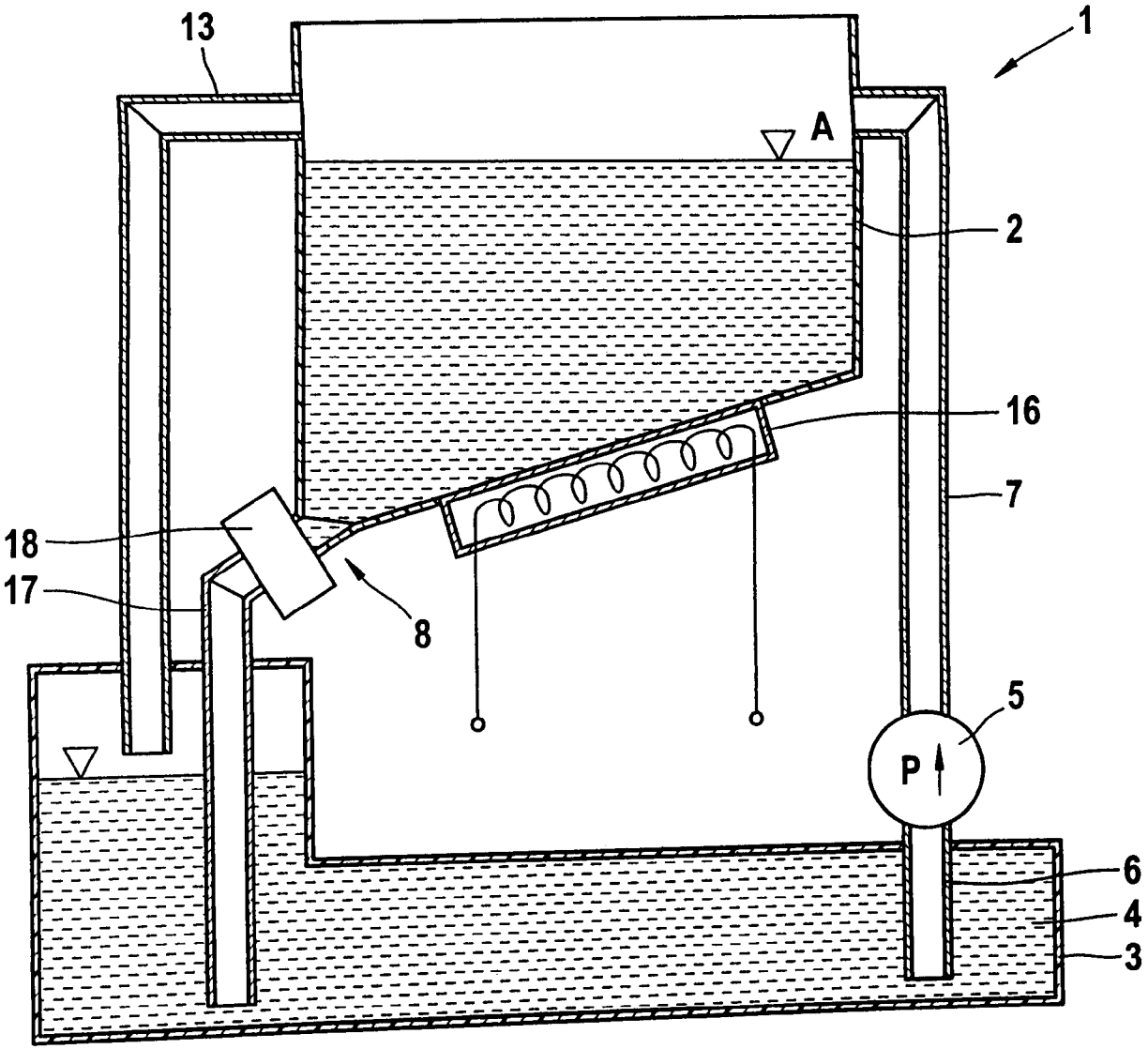
FIG. 2 is a schematic view of a second embodiment of the cleaning device.

FIG. 2 depicts another embodiment of the cleaning device 1 including a receptacle 2 is arranged above the reservoir 3 for the cleaning fluid 4. The pump 5 draws the cleaning fluid 4 from the reservoir 3 and conveys it through the inlet 7 into the receptacle 2. A channel 17 connecting the receptacle 2 to the reservoir 3 is connected to a lower region 8 of receptacle 2. In one embodiment,an electromagnetic valve 18 is disposed in the channel 17 for controlling flow therethrough. An overflow 13 provides again a safeguard to redirect cleaning fluid 4 from escaping from the cleaning device 1, e.g., if the electromagnetic valve 18 becomes defective. For cleaning purposes the receptacle 2 is filled with cleaning fluid up to the level A. With a known pump delivery rate, the pump 5 operates for a predetermined ON time, to fill the receptacle 2 up to level A. The ON time required is saved in the pump controller (not shown). As the inlet 7 leads into the receptacle 2 above the level A and the receptacle 2 is thus unable to drain empty through the inlet 7, no additional valve is needed in the inlet 7. In one embodiment, an electrical resistance heating element 16 is arranged in the lower region 8 in order to heat the cleaning fluid in the receptacle 2. When the receptacle 2 is to be emptied, the electromagnetic valve 18 is actuated allowing the cleaning fluid 4 to return to the reservoir 3 through the channel 17.

Figure 3:
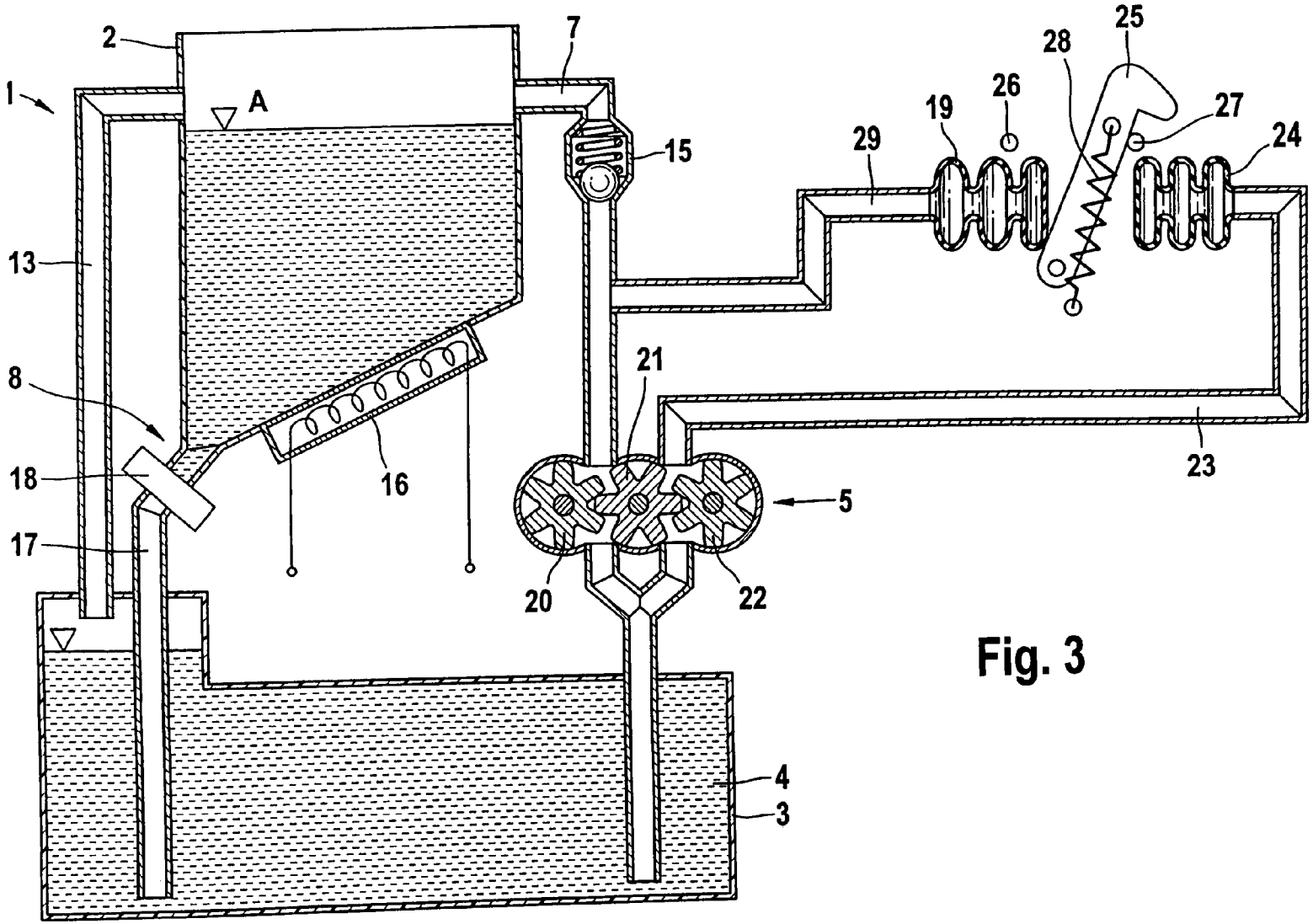
FIG. 3 is a view of an automatic locking device of the cleaning device.

FIG. 3 depicts another embodiment of the cleaning device 1 which includes a locking device actuated by the pump 5, for releasably securing the dry shaving apparatus (not shown) to the receptacle 2. The surroundings exterior surfaces of the cleaning device are protected from cleaning fluid escaping during the cleaning cycle. For better clarity of illustration, the locking device is shown as being arranged adjacent to the cleaning device, rotated through approximately 180° about its longate axis. In one embodiment, the pump 5 is a gear pump with three intermeshing gears 20, 21, 22, with the outer gears 20, 22 each forming one pump stage with the intermediate gear 21. The pump 5 has two outlets 7, 23. A conduit 29 branches from the outlet 7 and is connected to first actuating element 19. The outlet 23 leads to a second actuating element 24. The two actuating elements 19, 24 are constructed such that they move a locking element 25 between two limit positions 26, 27. A spring 28 biases the locking element 25 toward either of the two limit positions 26, 27. The dry shaving apparatus is inserted in the cleaning device 1 for cleaning. -At the beginning of the cleaning cycle the pump 5 feeds cleaning fluid through the outlet 7 into the conduit 29. The pressure of the cleaning fluid activates the actuating element 19 which moves the locking element 25 into the limit position 27. The dry shaving apparatus is secured by the locking element 25 in this limit position 27 to prevent accidental removal during the cleaning cycle. After the actuating element 19 is activated, the pressure in the conduits 7, 29 rises. Not until this higher pressure is reached does the check valve 15 open and cleaning fluid enters the receptacle 2. When the cleaning process has ended and the receptacle 2 has been evacuated, the direction of rotation of the pump 5 is reversed, causing cleaning fluid to be fed through the conduit 23 to the actuating element 24. As a result, the locking element 25 is moved into the limit position 26 thereby unlocking the dry shaving apparatus and allowing the shaver to be removed from the cleaning device 1. In one embodiment, the pump 5 can be a single-stage pump 5 in accordance with FIG. 1. instead of a two-stage reversible pump 5 of FIG. 3,if the cleaning fluid 4 supplied by the pump 5 can be optionally routed into either the conduit 29 or the conduit 23 using an additional control valve, e.g., an electrically switchable multi-way valve (not shown).

The entire cleaning cycle of the dry shaving apparatus in the cleaning device takes place under program control. In other words, the number and duration of the individual flushing or soaking operations of the shaving head can differ. For example, it is particularly advantageous for the shaving apparatus to have a device for determining the degree of contamination of its shaving head, as is described in detail in German Patent No. DE 196 06 719 A1 the entire contents of which are incorporated herein by reference. The corresponding cleaning program can then be called up and executed in accordance with the current contamination level. It is then possible for the cleaning to take place using cleaning fluid heated to different temperatures in accordance with the degree of contamination, and the number of flushing cycles can then also be varied accordingly.

As the information on the contamination level of the shaving head is saved in the dry shaving apparatus itself, both the dry shaving apparatus and the cleaning device need a communication interface through which, on the one hand, the information concerning the contamination level is sent from the dry shaving apparatus to the cleaning device and, on the other hand, the dry shaving apparatus receives a corresponding signal to reset the contamination signal after completion of the cleaning. The communication between the dry shaving apparatus and the cleaning device can take place either by way of direct conductive contacting or, particularly advantageously, in non-contacting manner by way of electromagnetic induction using a suitable electromagnetic field and the devices necessary therefor. Such a method for transmitting data between the dry shaving apparatus and the cleaning device is known from German Patent No. DE 198 17 273 A1. the entire contents of which are incorporated herein by reference.

If, for example, the dry shaving apparatus contains the information that quite a long time lies between its last uses and the last cleaning operation, it can be assumed that the soiling, and in particular the soiling due to serum, is already dried on and therefore difficult to dislodge. This information then results in the selection of a particularly intensive cleaning program with a higher temperature of the cleaning fluid and an increased number of flushing operations.

By contrast, a less intensive cleaning program without involving heating of the cleaning fluid and with a minimum number of flushing operations can be selected, without having to take sacrifices of cleaning quality into the bargain, in order to clean a shaving apparatus which was just used and whose last cleaning took place directly prior to its last use. Through this automatic adaptation of the cleaning programs in response to the actual contamination level of the dry shaving apparatus it is possible to minimize the consumption of electric power and cleaning fluid (unwanted evaporation) while at the same time ensuring an optimum cleaning effect.

The invention claimed is:

1. A cleaning device for the shaving head of a dry shaving apparatus, the device comprising:

a reservoir for storing a cleaning fluid;

a receptacle adapted to receive the shaving head and to be filled with the cleaning fluid up to a predetermined level;

a controllable drain through which the receptacle can be evacuated;

a heating element configured to heat the fluid in the receptacle; and a fluid impelling device configured to be driven by a motor for transferring the cleaning fluid from the reservoir into the receptacle during a cleaning cycle;

wherein the controllable drain is configured to prevent the cleaning fluid from draining from the receptacle prematurely, such that the motor can be switched off once the cleaning fluid has reached a level in the receptacle that is sufficient for cleaning.

2. The cleaning device of claim 1 wherein the controllable drain comprises a channel connecting a lower region of the receptacle to the reservoir.

3. The cleaning device of claim 2 wherein the reservoir is disposed underneath the receptacle.

4. The cleaning device of claim 3 wherein the channel comprises at least a section which is disposed above a maximum fluid level A for the cleaning cycle.

5. The cleaning device of claims 4, further comprising a bypass which connects the lower region of the receptacle to the channel along a downward path.

6. The cleaning device of claim 5 wherein the bypass comprises a small effective flow cross-section relative to the effective cross-section of the channel.

7. The cleaning device of claim 5 wherein the bypass comprises a material to reduce the rate of flow of the cleaning fluid from the receptacle to the channel.

8. The cleaning device of claim 7 wherein the material is a mat-type or wick-type fabric.

9. The cleaning device of claim 4 wherein the channel further comprises a closing device.

10. The cleaning device of claim 9 wherein the closing device comprises a valve.

11. The cleaning device of claim 10 wherein the valve comprises an electromagnetic valve.

12. The cleaning device of claim 9 wherein the closing device comprises movable elements operably linked to a flexible wall section of the channel to control a flow of cleaning fluid from the receptacle to the reservoir.

13. The cleaning device of claim 1, further comprising a level sensor for measuring a level of the cleaning fluid in at least one of the reservoir and the channel.

14. The cleaning device of claim 13 wherein the level sensor is proximate the section of the channel disposed above the maximum fluid level A.

15. The cleaning device of claim 13 wherein the level sensor comprises a switch actuated by a float.

16. The cleaning device of claim 13 wherein the level sensor is configured to measure at least one of the capacitance and the conductance of the cleaning fluid in contact therewith.

17. The cleaning device of claim 1, further comprising an inlet opening into the lower region of the receptacle and configured to transfer the cleaning fluid from the reservoir to the receptacle.

18. The cleaning device of claim 17 wherein the inlet opens into the receptacle at a level above a maximum fluid level A for the cleaning cycle.

19. The cleaning device of claim 17, further comprising a check valve arranged in the inlet.

20. The cleaning device of claim 2 wherein the receptacle comprises an overflow.

21. The cleaning device of claim 20 wherein a first end of the overflow opens into the receptacle at a level B above a maximum fluid level A.

22. The cleaning device of claim 21 wherein a second end of the overflow, opposite the first end, opens into at least one of the lower end of the channel and the reservoir.

23. The cleaning device of claim 21 wherein a second end of the overflow opens into the reservoir for the cleaning fluid.

24. The cleaning device of claim 1 wherein the heating element comprises an electrical resistor.

25. The cleaning device of claim 24 wherein the electrical resistor is a wire, a foil, a thick film, or a chemically or physically deposited thin film.

26. The cleaning device of claim 1 wherein the heating element (16) is disposed on an interior surface of receptacle.

27. The cleaning device of claim 1 wherein the heating element is disposed on an exterior surface of receptacle.

28. The cleaning device of claim 1, further comprising a thermal conductor disposed between the heating element and the cleaning fluid, the thermal conductor defining a thermal pathway between the cleaning fluid and the heating element.

29. The cleaning device of claim 1, further comprising an electrically insulating intermediate layer disposed between the heating element and the cleaning fluid.

30. The cleaning device of claim 1 wherein the heating element comprises a heating radiator.

31. The cleaning device of claim 1 wherein the heating element comprises metal heating elements adapted and configured to engage the flow of eddy currents induced in the cleaning fluid.

32. The cleaning device of claim 1 wherein a portion of the shaving head comprises the heating element.

33. The cleaning device of claim 1 wherein the heating element comprises at least first and second chemical substances, which combine to form an exothermal reaction.

34. The cleaning device of claim 1 wherein the receptacle is formed from an electrically conductive plastics material and comprises a heating element.

35. The cleaning device of claim 34 wherein the cleaning fluid comprises a starting substance for the exothermic reaction.

36. The cleaning device of claim 1, further comprising a heating element temperature sensor for monitoring the temperature of the heating element.

37. The cleaning device of claim 1, further comprising a fluid temperature sensor for monitoring the temperature the cleaning fluid contained in the receptacle.

38. The cleaning of claim 1 wherein the heating element comprises a temperature-responsive resistor.

39. The cleaning device of claim 1, further comprising a locking element to releasably attach the dry shaving apparatus to the cleaning device.

40. The cleaning device of claim 39 wherein the locking element is actuated automatically.

41. The cleaning device of claim 39 wherein the locking element is movable between two limit positions.

42. The cleaning device of claim 41 wherein the locking element is configured for movement between the limit positions as a function of the rotational direction of the pump.

43. The cleaning device of claim 42, further comprising first and second actuating elements configured for movement of the locking element.

44. The cleaning device of claim 43, further comprising a control valve for controlling the first and second actuating elements.

45. The cleaning device of claim 43 wherein the actuating elements are individually controllable.

46. The cleaning device of claim 43 wherein the control valve is disposed downstream of the pump.

47. A shaving system comprising:

the cleaning device of claim 1; and a dry shaving apparatus adapted and configured for use with the cleaning device.

48. A cleaning device for the shaving head of a dry shaving apparatus, the device comprising:

a receptacle adapted to receive the shaving head and to be filled with the cleaning fluid up to a predetermined level;

a reservoir disposed underneath the receptacle for storing a cleaning fluid;

a fluid impelling device configured to be driven by a motor for transferring the cleaning fluid from the reservoir into the receptacle during a cleaning cycle;

a controllable drain through which the receptacle can be evacuated, the drain comprising a channel connecting a lower region of the receptacle to the reservoir;

a heating device configured to heat the fluid in the receptacle; and a bypass which connects the lower region of the receptacle to the channel along a downward path;

wherein the controllable drain is configured to prevent the cleaning fluid from draining from the receptacle prematurely, such that the motor can be switched off once the cleaning fluid has reached a level in the receptacle that is sufficient for cleaning.

* * * * *

UNITED STATES PATENT AND TRADEMARK OFFICE

CERTIFICATE OF CORRECTION

PATENT NO. : 7,225,817 B2
APPLICATION NO. : 10/932505
DATED : June 5, 2007
INVENTOR(S) : Reinhold Eichhorn et al.

It is certified that error appears in the above-identified patent and that said Letters Patent is hereby corrected as shown below:

Column 9, Claim 1, Line 55
Delete "element" and Insert --device--

Signed and Sealed this

Twenty-sixth Day of August, 2008

JON W. DUDAS
*Director of the United States Patent and Trademark Office*